US006213085B1

(12) United States Patent
Durling et al.

(10) Patent No.: US 6,213,085 B1
(45) Date of Patent: Apr. 10, 2001

(54) DIRECTED JET SPARK PLUG

(75) Inventors: Harold E. Durling, Elsie; Joseph G. Ralph, Owosso, both of MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/241,903

(22) Filed: Feb. 2, 1999

(51) Int. Cl.[7] ..... F02B 19/00
(52) U.S. Cl. ..... 123/266; 123/273
(58) Field of Search ..... 123/266, 268, 123/260, 273, 286

(56) References Cited

U.S. PATENT DOCUMENTS

| | | | | |
|---|---|---|---|---|
| 4,256,071 | * | 3/1981 | Casull | 123/266 |
| 4,646,695 | * | 3/1987 | Blacjburm | 123/266 |
| 4,903,656 | * | 2/1990 | Nakazono et al. | 123/266 |
| 4,987,868 | * | 1/1991 | Richardson | 123/266 |
| 5,014,656 | | 5/1991 | Leptich et al. | 123/169 |
| 5,297,518 | * | 3/1994 | Cherry | 123/266 |
| 5,405,280 | | 4/1995 | Polikarpus et al. | 445/7 |
| 5,421,300 | | 6/1995 | Durling et al. | 123/266 |
| 5,947,076 | * | 9/1999 | Srinivasan et al. | 123/266 |

FOREIGN PATENT DOCUMENTS

| | | |
|---|---|---|
| 3305153 | 8/1984 | (DE) . |
| 3305153A1 | 8/1984 | (DE) . |
| WO85/02066 | 5/1985 | (WO) . |

* cited by examiner

*Primary Examiner*—John Kwon
(74) *Attorney, Agent, or Firm*—Scott A. McBain

(57) ABSTRACT

A torch jet spark plug (10) for use in a spark ignition system of an internal combustion engine. The spark plug (10) of this invention provides for ignition of an air/fuel mixture within a combustion prechamber (12) within the plug (10), which creates a jet of burning gases that are propelled through an orifice (32) into the engine main combustion chamber to increase the burning rate of the air/fuel mixture within the combustion chamber. The orifice (32) is oriented in the plug (10) so that its axis is not parallel with the longitudinal axis of the plug (10), enabling the jet of burning gases to be selectively directed to any desired region within the combustion chamber, such as a region within the chamber that would not otherwise burn well compared to other regions of the chamber.

25 Claims, 2 Drawing Sheets

DIRECTED JET SPARK PLUG

FIELD OF THE INVENTION

The present invention generally relates to spark plugs of the type that provide torch jet-assisted spark ignition of an air/fuel mixture within a main combustion chamber of an internal combustion engine. In particular, this invention is directed to a torch jet spark plug having a nozzle disposed at an angle to the axis of the plug, which enables flame propagation from the plug to be directed to a specific location within the combustion chamber.

BACKGROUND OF THE INVENTION

Spark ignition of an air/fuel mixture within a combustion chamber of an internal combustion engine typically involves igniting the air/fuel mixture with an electric spark jumped between an electrode and a ground electrode of a spark plug. An alternative to spark ignition known in the art is torch jet-assisted spark ignition which, as taught by U.S. Pat. Nos. 3,921,605 to Wyczalek, 4,924,829 to Cheng et al., 5,405,280 to Polikarpus et al., and 5,421,300 to Durling et al., offers several advantages over spark ignition approaches. As the name suggests, torch jet-assisted spark ignition utilizes a jet of burning gases that are propelled into the combustion chamber in order to enhance the burning rate within the combustion chamber by providing increased turbulence as well as presenting a larger flame front area. As a result of a faster burning rate, lower cyclic variation in cylinder pressure is achieved, which enables a higher engine efficiency with a higher compression ratio.

In a torch jet-assisted spark ignition system, the jet typically emanates from a combustion prechamber within the spark plug, passing through an orifice into the main combustion chamber. The axis of the orifice is parallel and often coaxial with the combustion prechamber. Though an air/fuel mixture can be introduced directly into the prechamber through a separate intake valve or fuel injector, it is generally preferable that the air/fuel mixture originates from the main chamber in order to simplify the construction of the engine and its ignition system. Combustion of the air/fuel mixture within the prechamber can be initiated from within by a separate igniter, or initiated by the flame front within the main chamber. With either approach, combustion typically proceeds relatively simultaneously in both the prechamber and the main chamber. However, because of the small relative volume of the prechamber, a high pressure is developed in the prechamber while the pressure is still relatively low in the main chamber. As a result, a jet of burning gases shoots from the prechamber far into the main chamber, significantly increasing the combustion rate in the main chamber.

Engine testing of torch jet spark plugs has verified that torch jet-assisted ignition results in faster burn rates than conventional spark ignition techniques, which produce a fixed flame "kernel" and relies on engine design to achieve suitable flame propagation within the main chamber. Torch jet-assisted ignition also relies on engine design considerations, which include tailoring swirl, turbulence and valve design to control the fuel/air charge for more complete and faster burns. Even with optimal engine design, there are typically regions within a main chamber in which the fuel/air mixture does not burn well, resulting in lower combustion efficiency. Accordingly, further enhancements in combustion efficiency using torch jet-assisted ignition would be desirable, the result of which would provide increased power, reduced emissions and better fuel economy for a given engine design.

SUMMARY OF THE INVENTION

According to the present invention, there is provided a torch jet spark plug for use in a spark ignition system of an internal combustion engine. As with prior art torch jet spark plugs, the spark plug of this invention provides for the ignition of an air/fuel mixture within a combustion prechamber within the plug, and then propels the resulting burning gases through an orifice and into the engine main combustion chamber to increase the burning rate of the air/fuel mixture within the combustion chamber. However, the spark plug of this invention further promotes combustion efficiency by enabling the jet of burning gases to be selectively directed to any desired region within a combustion chamber, such as a region within the chamber that would not otherwise burn well compared to other regions of the chamber.

The spark plug of this invention generally includes a body having an interior chamber ("prechamber") and an orifice in fluidic communication with the chamber for venting the chamber to the exterior of the body. Contrary to prior art torch jet spark plugs, the orifice is oriented in the body so that its axis is not parallel or coaxial with the longitudinal axis of the body, i.e., an angle of greater than zero from the longitudinal axis of the body. The orifice provides the only vent between the chamber and the exterior of the body, and may be disposed at an angle of up to about 30 degrees from the axis of the body.

The torch jet spark plug of this invention is capable of being used as a production plug or adapted for engine design and development. As a production plug, the body includes means for establishing the rotational orientation of the plug in a spark plug well, so that the orifice will be properly oriented to optimize the benefits gained by selectively directing the torch jet into the combustion chamber. In this embodiment, the position of the torch jet spark ignition device is preferably limited to a single orientation within its corresponding well. For design and development purposes, the body is used in conjunction with means that enables the orientation of the body to be selectively varied within a spark plug well, so that combustion conditions can be evaluated with the torch jet directed into different areas of a combustion chamber. In this embodiment, the torch jet spark ignition device is configured to be positively secured in any one of a plurality of orientations in the well.

In accordance with the above, the spark plug of this invention can be used to compensate in part for conventional engine design considerations, such as swirl, turbulence and valve design, to control the fuel/air charge for more complete and faster burns. Specifically, the spark plug can be oriented to promote combustion within a region of a combustion chamber in which a fuel/air mixture would not otherwise burn well, resulting in higher combustion efficiency. Simultaneously, jet velocities can be altered by tailoring the chamber and orifice sizes to achieve burn rates and intensities that are compatible with, and possibly augment the effects of, a particular burn direction. Accordingly, this invention enables significant enhancements in combustion efficiency using torch jet-assisted ignition, the result of which is increased power, reduced emissions and better fuel economy for a given engine design.

The spark plug of this invention also promotes engine design flexibility by permitting spark plug location to be determined by considerations other than spark location. Specifically, the angled orifice employed by this invention permits the selective "placement" of the torch jet in regions of the combustion chamber other than directly below the spark plug. As a result, spark location within the combustion chamber does not dictate spark plug placement at the expense of other considerations, such as accessibility for service, availability of cooling passages in the cylinder head, and avoidance of engine valves and head bolts. Accordingly, engine packaging and combustion performance can both be improved with the spark plug of this invention.

Another significant advantage of this invention is that the plug can be used during engine development and testing to generate combustion data for different flame propagation directions and rates within an engine without necessitating modifications to engine hardware. A particularly notable aspect of this capability is that the plug can assist in efforts to evaluate emission levels and knock-limited power levels, which depend in part on flame propagation and intensity. As a result, use of the plug of this invention during engine cylinder development is able to save time and reduce the costs required to optimize combustion chamber geometry.

Other objects and advantages of this invention will be better appreciated from the following detailed description.

BRIEF DESCRIPTION OF THE DRAWINGS

The present invention will now be described, by way of example, with reference to the accompanying drawings, in which.

DETAILED DESCRIPTION OF THE INVENTION

Figure 1:
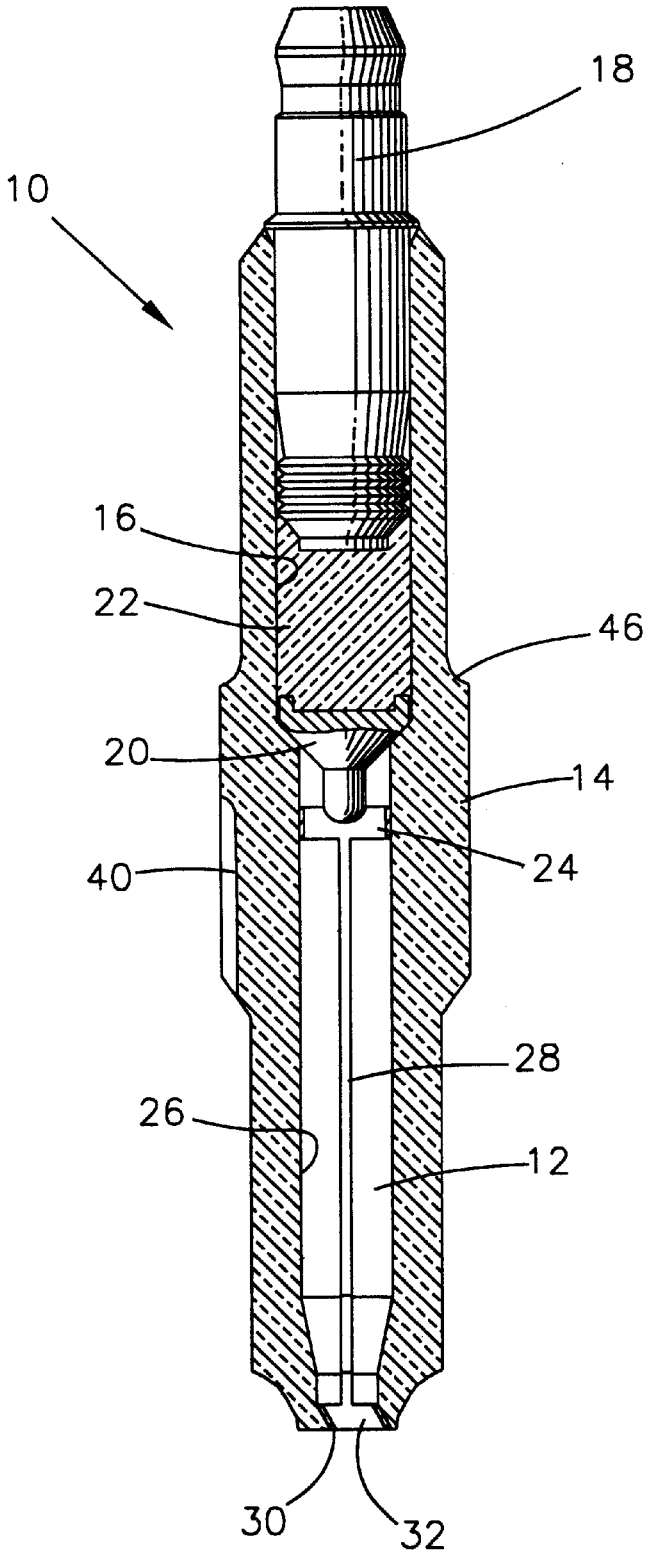
FIG. 1 shows a cross-sectional view along the longitudinal axis of a torch jet spark plug in accordance with this invention.

Shown in FIG. 1 is a torch jet spark plug 10 for use in a spark ignition system for an internal combustion engine. In accordance with torch jet-assisted ignition techniques, the torch jet spark plug 10 of this invention serves to increase the burning rate of an air/fuel mixture within a combustion chamber of an internal combustion engine by igniting an air/fuel mixture within a combustion prechamber 12 formed in the insulator body 14 of the spark plug 10. While those skilled in the art will recognize that the present invention is constructed to be particularly suitable for use in an automotive internal combustion engine, the teachings of the present invention are also applicable to other spark plug configurations, as well as other applications which utilize internal combustion processes for power generation.

As with spark plugs typically used with internal combustion engines, the insulator body 14 is preferably formed of a ceramic material, such as alumina ($Al_2O_3$). One end of the body 14 includes a passage 16 in which an upper terminal 18 is received, by which an electric voltage can be supplied to the spark plug 10. As seen in FIG. 1, an electric voltage introduced at the upper terminal 18 is conducted to a center electrode 20 through a resistor material 22 disposed in the passage 16 in the insulator body 14. The center electrode 20 protrudes into the prechamber 12, which is located in the body 14 opposite the upper terminal 18. The resistor material 22 is preferably a glass seal resistor material of a type known in the art, which provides electromagnetic interference suppression while also hermetically sealing the passage 16 from the prechamber 12.

As depicted in FIG. 1, an inner electrode 24 is disposed on the internal surface 26 of the prechamber 12 surrounding the center electrode 20, and an outer hollow electrode 30 is located on the wall of an orifice 32 to the prechamber 12. The inner electrode 24 is in the form of an annular-shaped band that circumscribes the center electrode 20 to form a radial inner spark gap. The hollow electrode 30 is also in the form of an annular-shaped band and is interconnected with the inner electrode 24 by a conductive "stripe" 28 on the surface 26 of the prechamber 12. As such, the hollow electrode 30 acts as an extension of the inner electrode 24, and forms one electrode of an outer spark gap, which will be described below. The stripe 28 and the inner and hollow electrodes 24 and 30 are preferably formed by an adherent metal coating on the internal surface 26 of the prechamber 12, such as in the manner taught by U.S. Pat. No. 5,421,300 to Durling et al. The inner and hollow electrodes 24 and 30 and the stripe 28 can be formed by a metal layer that substantially covers the entire internal surface 26 of the prechamber 12 below the center electrode 20 as taught by U.S. Pat. No. 5,405,280 to Polikarpus et al., such that an electrical capacitor is effectively formed. Various materials and processes can be used to form the electrodes 24 and 30 and stripe 28 in accordance with the teachings of Polikarpus et al. and Durling et al., both of which are incorporated herein by reference.

As shown in FIG. 1, the prechamber 12 is elongate and extends along the longitudinal axis of the insulator body 14. The orifice 32 serves to vent the prechamber 12 to the main combustion chamber of an engine in which the spark plug 10 is installed. The orifice 32 allows for the intake of the air/fuel mixture during the compression stroke of a cylinder in which the plug 10 is installed, as well as the expulsion of combustion gases upon ignition of the air/fuel mixture within the prechamber 12, which is initiated by the center and inner electrodes 20 and 24.

As shown, the axis of the orifice 32 intersects but is oriented at an angle to the longitudinal axis of the insulator body 14. While shown as being generally centrally located at the end of the body 14, the orifice 32 could be radial offset. According to this invention, selective orientation of the plug 10 within a spark plug well, such as the well 34 shown in FIG. 2, can be used to optimize the burn direction and intensity within a combustion chamber 36 in which the plug 10 is installed. In conjunction with the orifice angle, the volume of the prechamber 12 and the area of the orifice 32 can be selected to provide the desired characteristics for a particular engine and effect that is of interest. For a given prechamber volume, a relatively small orifice diameter restricts the exit of gasses from the prechamber 12, causing higher prechamber pressures and higher velocity jets when the plug 10 is fired, while a relatively large orifice diameter results in lower velocity jets. Excessively small orifices 32 restrict filling of the prechamber 12 during the engine compression stroke, especially at high engine speeds. Larger prechamber volumes produce longer duration jets, but introduce additional surface area to the combustion chamber, which is undesirable from the standpoint of heat loss and emissions.

From the above, it can be seen that there is no single preferred orifice angle, orifice diameter and prechamber volume combination for all engines, and persons skilled in the art will recognize that there are potential advantages of various combinations. For illustrative purposes, one such combination which has been found to perform suitably involves the use of a prechamber 12 whose volume is on the order of about 0.2 to about 0.4 cubic centimeters, in combination with a central orifice 32 having a cross-sectional area of about 1.7 to about 3.8 square millimeters and whose axis is disposed about 20 degrees from the longitudinal axis of the prechamber 12.

Figure 2:
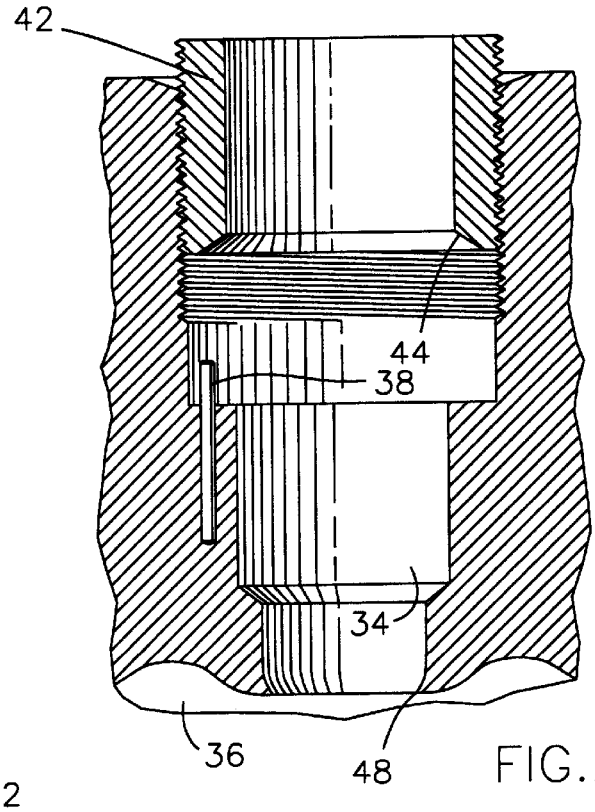
FIG. 2 is a cross-sectional view of a spark plug well configured to receive the spark plug of FIG. 1 in accordance with one embodiment of this invention.

The well 34 shown in FIG. 2 is configured for production, in the sense that a locating pin 38 is present within the well 34 for dictating the orientation of the plug 10 within the well 34. For this purpose, the plug 10 is equipped with a suitable surface feature, such as the groove or recess 40 shown in FIG. 1 as being formed in the body 14. In accordance with the embodiment of FIG. 2, only one orientation of the plug 10 within the well 34 is possible. The plug 10 can then be secured in the well 34 with any suitable means, such as the fitting 42 shown in FIG. 2. The fitting 42 is threaded to allow tightening until a lower shoulder 44 of the fitting contacts the shoulder 46 of the plug body 14. A gasket (not shown) formed of a suitable temperature-resistant material, such as copper or soft steel, can be positioned between the fitting 42 and the shoulder 46 of the insulator body 14 to create a gas-tight seal.

In the embodiment shown in FIG. 2, a ground terminal 48 is formed by the surrounding metal of the cylinder head. When the plug 10 is installed in the well 34, the hollow electrode 30 is immediately adjacent and surrounded by the ground terminal 48, such that the hollow electrode 30 and ground terminal 48 form an outer spark gap that is radially oriented in a manner somewhat similar to the spark gap between the center and inner electrodes 20 and 24.

Figure 3:
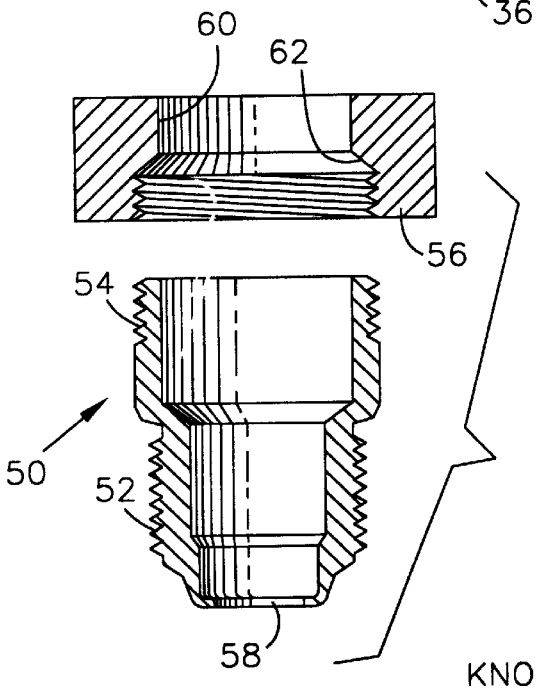
FIG. 3 is a cross-sectional view of a shell configured for assembly with the spark plug of FIG. 1 in accordance with another embodiment of this invention.

FIG. 3 depicts a shell 50 for use with the torch jet spark plug 10 of FIG. 1 in accordance with an embodiment of this invention intended for engine development and testing. The insulator body 14 of the plug 10 is installed and secured in the shell 50 with a locknut 56. When assembled, the upper end of the body 14 extends through a reduced diameter section 60 of the locknut 56, and a shoulder 62 of the locknut 56 engages the shoulder 46 of the insulator body 14 to secure the body 14 within the shell 50. A gasket (not shown) of a suitable temperature-resistant material is preferably present between the shell 50 and the insulator body 14 to create a gas-tight seal. External threads 52 and 54 are formed at both ends of the shell 50. As is conventional, the lower threads 52 are for the purpose of installing the spark plug 10 in a threaded portion of a spark plug well (not shown). The insulator body 14 will project through an opening 58 in the lower end of the shell 50 adjacent the threads 52. The perimeter of the opening 58 serves as the ground terminal for the hollow electrode 30, though it is foreseeable that other ground terminal configurations could be used.

Once the shell 50 (FIG. 3) is installed in the combustion chamber, the plug 10 (FIG. 1) can be inserted into the shell 50, rotated to the desired jet direction, and locked into place with a locknut 56 threaded onto the upper set of threads 54. Importantly, the plug 10 is not restricted by its configuration to any particular angular orientation within the shell 50. As a result, the locknut 56 can be tightened to secure the plug 10 after the plug 10 has been properly oriented to direct the orifice 32 toward a desired region within the combustion chamber.

With either embodiment of this invention, it can be seen that, upon charging the prechamber 12 with a suitable air/fuel mixture from an engine's main combustion chamber during a compression stroke, an electric voltage supplied to the spark plug 10 via the upper terminal 18 will generate an electric spark at the spark gap between the center and inner electrodes 20 and 24, which will ignite the air/fuel mixture within the prechamber 12. Electric current is also then conducted along the metal stripe 28 to the hollow electrode 30, where a second spark is generated to ignite the air/fuel mixture within the main combustion chamber. Though combustion proceeds relatively simultaneously in both the prechamber 12 and the main chamber, the smaller relative volume of the prechamber 12 results in a high pressure being developed within the prechamber 12 while the pressure within the main combustion chamber is still relatively low. As a result, a jet which initially includes an unburned portion of the prechamber's air/fuel mixture will be expelled from the prechamber 12, become ignited by the external flame kernel of the outer spark gap, and then travel far into any predetermined region of the main chamber based on the angular orientation of the orifice 32, thereby significantly increasing the combustion rate within the main chamber.

Figure 4:
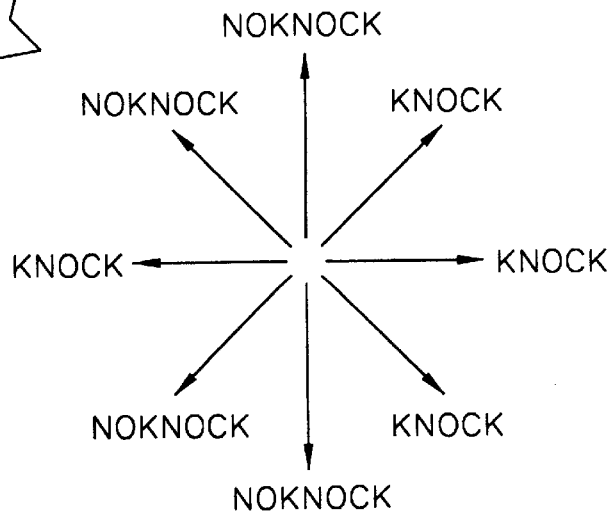
FIG. 4 schematically shows results of varying the direction of burn within a combustion chamber using the spark plug of FIG. 1.

FIG. 4 represents information gathered from a series of tests using a torch jet spark plug similarly configured to that shown in FIG. 1, which was assembled with a shell similar to that of FIG. 3. The orifice angle relative to the longitudinal axis of the prechamber 12 was about 20 degrees. The spark plug was indexed through eight different rotational orientations spaced about 45 degrees apart, and the engine run under identical conditions to evaluate what effect orifice orientation would have on the occurrence of engine knocking. As indicated, engine knocking occurred at four of the eight orientations. None of these events could have been predicted with any accuracy. To obtain the same test conditions without the spark plug of this invention, eight different cylinder heads would have to be fabricated at considerable cost and time.

While the invention has been described in terms of a preferred embodiment, it is apparent that other forms could be adopted by one skilled in the art. For example, appropriate materials could be substituted, and the teachings of this invention could be employed in different environments. Accordingly, the scope of the invention is to be limited only by the following claims.

What is claimed is:

1. A torch jet spark ignition device comprising a body having an exterior and an axis, a chamber within the body, and an external orifice in fluidic communication with the chamber for venting the chamber to the exterior of the body, the orifice having an axis that is not parallel with the axis of the body and including an annular shaped electrode within said orifice.

2. A torch jet spark ignition device as recited in claim 1, wherein the orifice is the only vent between the chamber and the exterior of the body.

3. A torch jet spark ignition device as recited in claim 1, wherein the orifice is disposed at an angle of greater than zero to about 30 degrees from the axis of the body.

4. A torch jet spark ignition device as recited in claim 1, further comprising means for limiting the position of the torch jet spark ignition device to a single orientation within a spark plug well.

5. A torch jet spark ignition device as recited in claim 4, wherein the limiting means comprises a recess in the exterior of the body.

6. A torch jet spark ignition device as recited in claim 4, further comprising a fitting with an internal bore and external threads, the body of the torch jet spark ignition device being received in the bore of the fitting.

7. A torch jet spark ignition device as recited in claim 1, further comprising means for enabling the torch jet spark ignition device to be secured in any one of a plurality of orientations in a spark plug well.

8. A torch jet spark ignition device as recited in claim 7, wherein the enabling means comprises a metal shell and a locknut, the metal shell having an internal bore in which the body of the torch jet spark ignition device is received, the metal shell having external threads with which the locknut is retained on the metal shell.

9. A torch jet spark ignition device as recited in claim 1, wherein the chamber has a first end spaced apart from the orifice and a second end disposed adjacent the orifice, the torch jet spark ignition device further comprising;

a first electrode at the first end of the chamber;

an annular-shaped second electrode disposed at the first end of the chamber and surrounding the first electrode to form an annular-shaped gap therewith;

an annular-shaped third electrode disposed within the orifice;

means within the chamber for electrically interconnecting the second and third electrodes; and a ground electrode adjacent the third electrode and forming a gap therewith.

10. A torch jet spark ignition device comprising:

an electrically-nonconductive body having an exterior, a longitudinal axis, oppositely-disposed first and second longitudinal ends, and an internal chamber, the chamber having a first end and an oppositely-disposed second end at the second longitudinal end of the body;

an external orifice in the body at the second end of the chamber for venting the chamber to a combustion chamber when the torch jet spark ignition device is installed in the combustion chamber, the orifice having an axis that is not parallel with the longitudinal axis of the body;

a first electrode projecting into the first end of the chamber;

an annular-shaped second electrode disposed at the first end of the chamber and surrounding the first electrode to form an annular-shaped inner gap therewith;

an annular-shaped third electrode disposed within the orifice;

an electrical conductor on the body within the chamber and electrically interconnecting the second and third electrodes; and a ground electrode adjacent the third electrode and forming an outer gap therewith.

11. A torch jet spark ignition device as recited in claim 10, wherein the orifice is the only vent between the chamber and the exterior of the body.

12. A torch jet spark ignition device as recited in claim 10, wherein the orifice is disposed at an angle of greater than zero to about 30 degrees from the longitudinal axis of the body.

13. A torch jet spark ignition device as recited in claim 10, wherein the orifice is disposed at an angle of about 20 degrees from the longitudinal axis of the body.

14. A torch jet spark ignition device as recited in claim 10, further comprising means for limiting the position of the torch jet spark ignition device to a single orientation within a spark plug well.

15. A torch jet spark ignition device as recited in claim 14, wherein the limiting means is a recess in the exterior of the body.

16. A torch jet spark ignition device as recited in claim 14, further comprising a fitting with an internal bore and external threads, the body of the torch jet spark ignition device being received in the bore of the fitting.

17. A torch jet spark ignition device as recited in claim 10, further comprising means for enabling the torch jet spark ignition device to be secured in any one of a plurality of orientations in a spark plug well.

18. A torch jet spark ignition device as recited in claim 17, wherein the enabling means comprises a metal shell and a locknut, the metal shell having an internal bore in which the body of the torch jet spark ignition device is received, the metal shell having first external threads at a first end thereof for securing the torch jet spark ignition device within a spark plug well, the metal shell having second external threads at a second end thereof with which the locknut is retained on the metal shell.

19. A torch jet spark ignition device as recited in claim 10, wherein the ground electrode is defined by an adjacent surface of a metallic body in which the torch jet spark ignition device is received.

20. A torch jet spark ignition device comprising a single insulation body having an exterior and a longitudinally extending axis, a chamber within the body having a first end and a second end axially opposite said first end, a first electrode projecting into said first end of said chamber, a second electrode disposed at said first end of said chamber to form a spark gap with said first electrode, an external orifice in fluidic communication with said second end of said chamber for venting the chamber to the exterior of the body, a third electrode disposed within said orifice, said orifice having an axis that is not parallel with the axis of the body.

21. The torch jet spark ignition device as recited in claim 20, wherein said exterior of said body includes a longitudinally extending recess.

22. The torch jet spark ignition device of claim 20, including an electrical conductor interconnecting said second electrode and said third electrode.

23. A torch jet spark ignition device comprising a body having an exterior and an axis, a chamber within said body having a first end and a second end, a first spark gap located adjacent said first end, an external orifice extending between said second end of said chamber and said exterior of said body, said orifice having a second spark gap and an axis that is not parallel with the axis of the body.

24. The torch jet spark ignition device of claim 23, wherein said exterior of said body includes a longitudinally extending recess.

25. The torch jet spark ignition device of claim 23, including an electrical conductor interconnecting said first spark gap and said second spark.

* * * * *